US006921316B1

(12) United States Patent
Jian

(10) Patent No.: US 6,921,316 B1
(45) Date of Patent: Jul. 26, 2005

(54) BRA WITH A MASSAGING FUNCTION

(75) Inventor: Jin-Yi Jian, Taoyuan (TW)

(73) Assignee: By-Style International Co., Ltd., Taoyuan (TW)

( * ) Notice: Subject to any disclaimer, the term of this patent is extended or adjusted under 35 U.S.C. 154(b) by 0 days.

(21) Appl. No.: 10/975,511

(22) Filed: Oct. 27, 2004

(51) Int. Cl.[7] ..... A41C 3/00
(52) U.S. Cl. ..... 450/38; 450/57; 450/81
(58) Field of Search ..... 450/38, 39, 53, 450/54–57, 93, 81; 2/463, 92, DIG. 3; 623/7, 8

(56) References Cited

U.S. PATENT DOCUMENTS 5,782,671 A * 7/1998 Suen et al. ..... 450/38
5,997,380 A * 12/1999 Yang ..... 450/57
6,080,037 A * 6/2000 Lee et al. ..... 450/38
6,302,760 B1 * 10/2001 Dai ..... 450/38
6,461,221 B1 * 10/2002 Stilwell et al. ..... 450/57
6,811,463 B2 * 11/2004 Martz ..... 450/57

* cited by examiner

*Primary Examiner*—Gloria M. Hale
(74) *Attorney, Agent, or Firm*—Pro-Techtor International Services

(57) ABSTRACT

A bra includes a body made of silicone rubber and having an outline for mating with that of a female bosom. The body includes a reinforcing rib formed along a perimeter thereof. A rear member is mounted to an inner side of the body. An air chamber is defined between the rear member and the body. The rear member includes a plurality of protrusions formed on an outer face thereof. The protrusions are in contact with the female bosom for massaging the female bosom. Further, gaps are formed among the protrusions for ventilation.

17 Claims, 15 Drawing Sheets

BRA WITH A MASSAGING FUNCTION

BACKGROUND OF THE INVENTION

1. Field of the Invention

The present invention relates to a bra. In particular, the present invention relates to a bra with a massaging function.

2. Description of the Related Art

Bras provide a support for the bosom of a user. Some of the bras include a soft padding sewn to an inner side thereof to present a bosomy appearance. However, the sewing procedure is troublesome and time-consuming. Further, the bras with sewn paddings could not provide an intimate contact with the bosom of the user. Adhesive type bras have been proposed, wherein the rear side of the bra is applied with adhesive or an adhesive tape for direct contact with the bosom of the user. However, it was found that long-term wearing of such a bra is uncomfortable, as the bra is not permeable to air. Further, no other function is provided.

SUMMARY OF THE INVENTION

An objective of the present invention is to provide a bra with a massaging function.

Another objective of the present invention is to provide a bra with a ventilating function.

In accordance with an aspect of the present invention, a bra comprises a body made of silicone rubber and including an outline for mating with that of a female bosom. The body includes a reinforcing rib formed along a perimeter thereof. A rear member is mounted to an inner side of the body. An air chamber is defined between the rear member and the body. The rear member includes a plurality of protrusions formed on an outer face thereof. The protrusions are in contact with the female bosom for massaging the female bosom. Further, gaps are formed among the protrusions for ventilation.

In an embodiment of the invention, the rear member extends from a bottom of the inner side of the body to an intermediate portion of the inner side the body.

In another embodiment of the invention, the rear member extends from a bottom of the inner side of the body to an upper portion of the inner side the body.

In an embodiment of the invention, the body further includes a double side tape mounted to the inner side of the body and extending along the perimeter of the body.

The body may further include at least one projection formed on at least one of an inner side and an outer side of an upper portion of the body and located above the air chamber. At least one vent is defined in the body and located above the air chamber.

The reinforcing rib may further include at least one lug formed thereon. The lug includes a longitudinal hole for coupling with a strap or for coupling with another bra.

The bra may further include a plurality of vents in a jointing area between the reinforcing rib and the perimeter of the body. The reinforcing rib may further include a plurality of grooves each of which is communicated with two ends of an associated one of the vents.

The body and the rear member may be integrally or separately formed.

The bra may be integrally formed with a similarly constructed bra.

In a further embodiment of the invention, the rear member includes a loop portion fixed to the inner side of the member, defining a compartment with an opening. A bladder is mounted into the compartment and defines the air chamber.

In still another embodiment of the invention, the bra includes a valve for controlling an amount of air in the air chamber.

In yet another embodiment of the invention, the bra includes a hand-operating pump mounted to an inner face of the rear member for controlling an amount of air in the air chamber.

The bra may further include a filling mounted in the air chamber. The filling may be magnetic particles, polystyrene particles, or light-emitting particles.

Other objectives, advantages, and novel features of the invention will become more apparent from the following detailed description when taken in conjunction with the accompanying drawings.

DETAILED DESCRIPTION OF THE PREFERRED EMBODIMENTS

Figure 1:
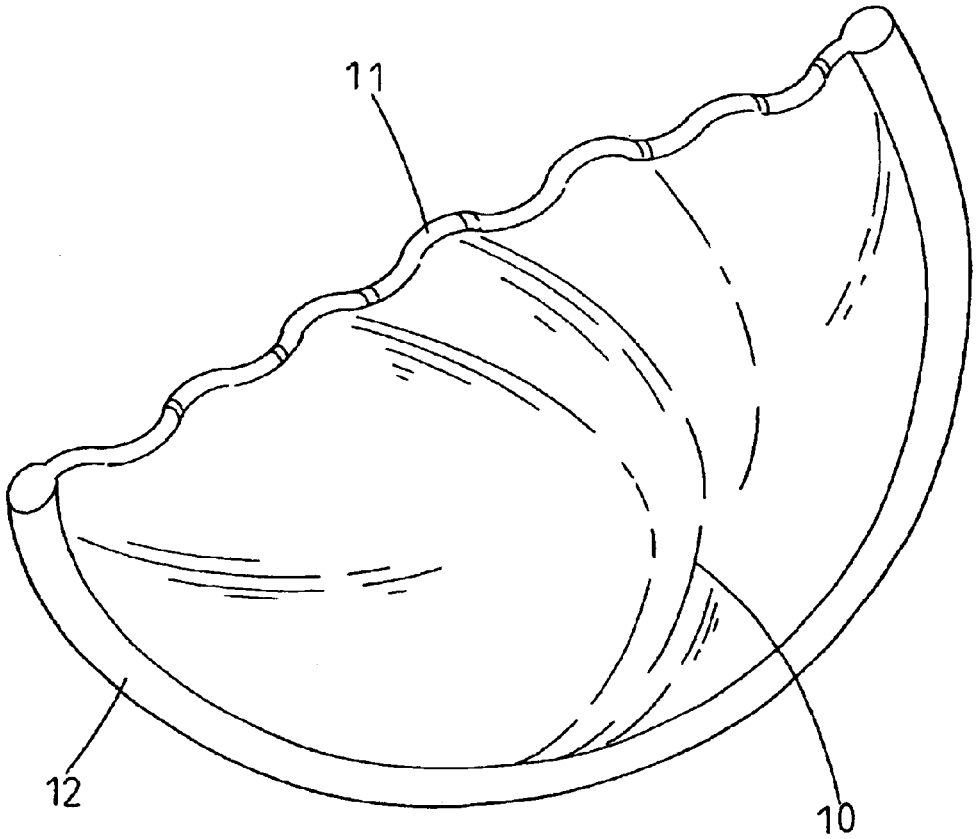
FIG. 1 is a front perspective view of a first embodiment of a bra in accordance with the present invention.
Figure 2:
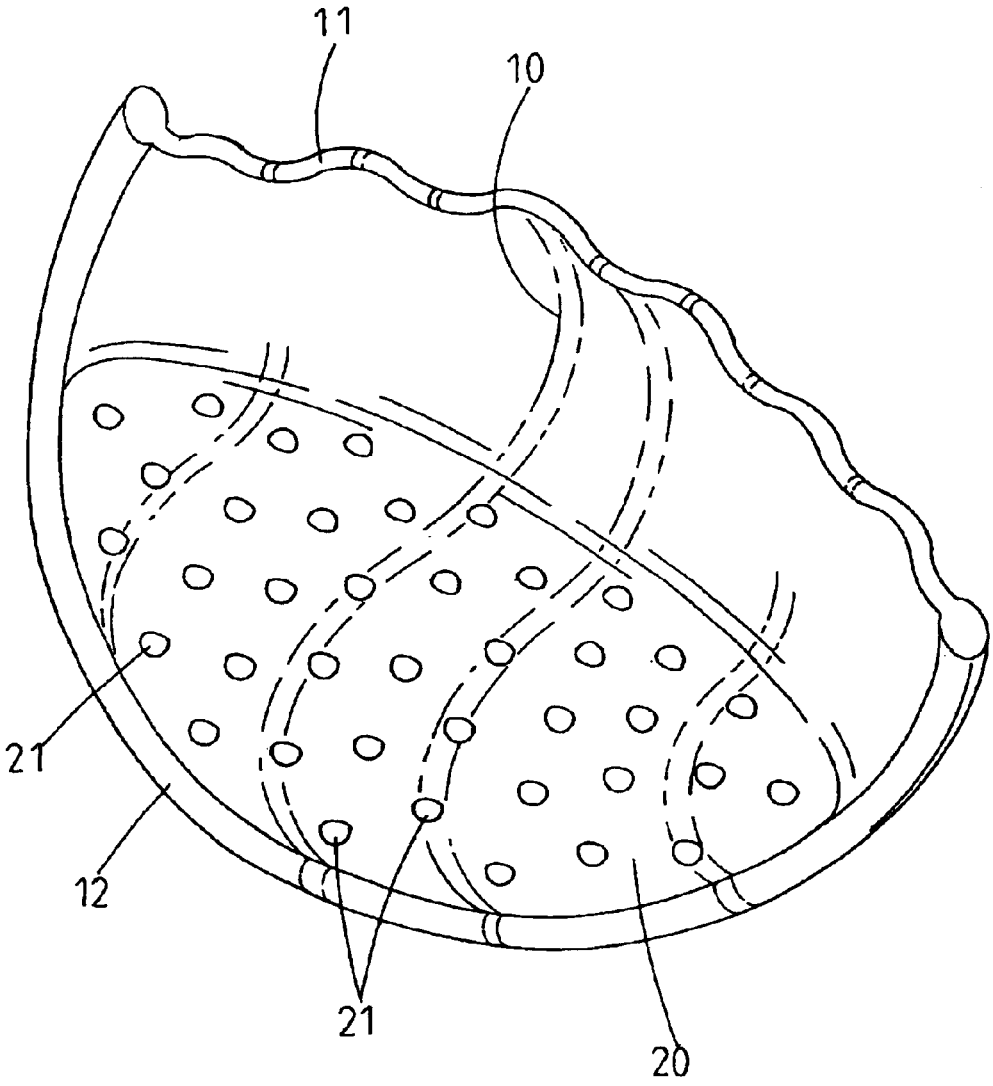
FIG. 2 is a rear perspective view of the bra in FIG. 1.
Figure 3:
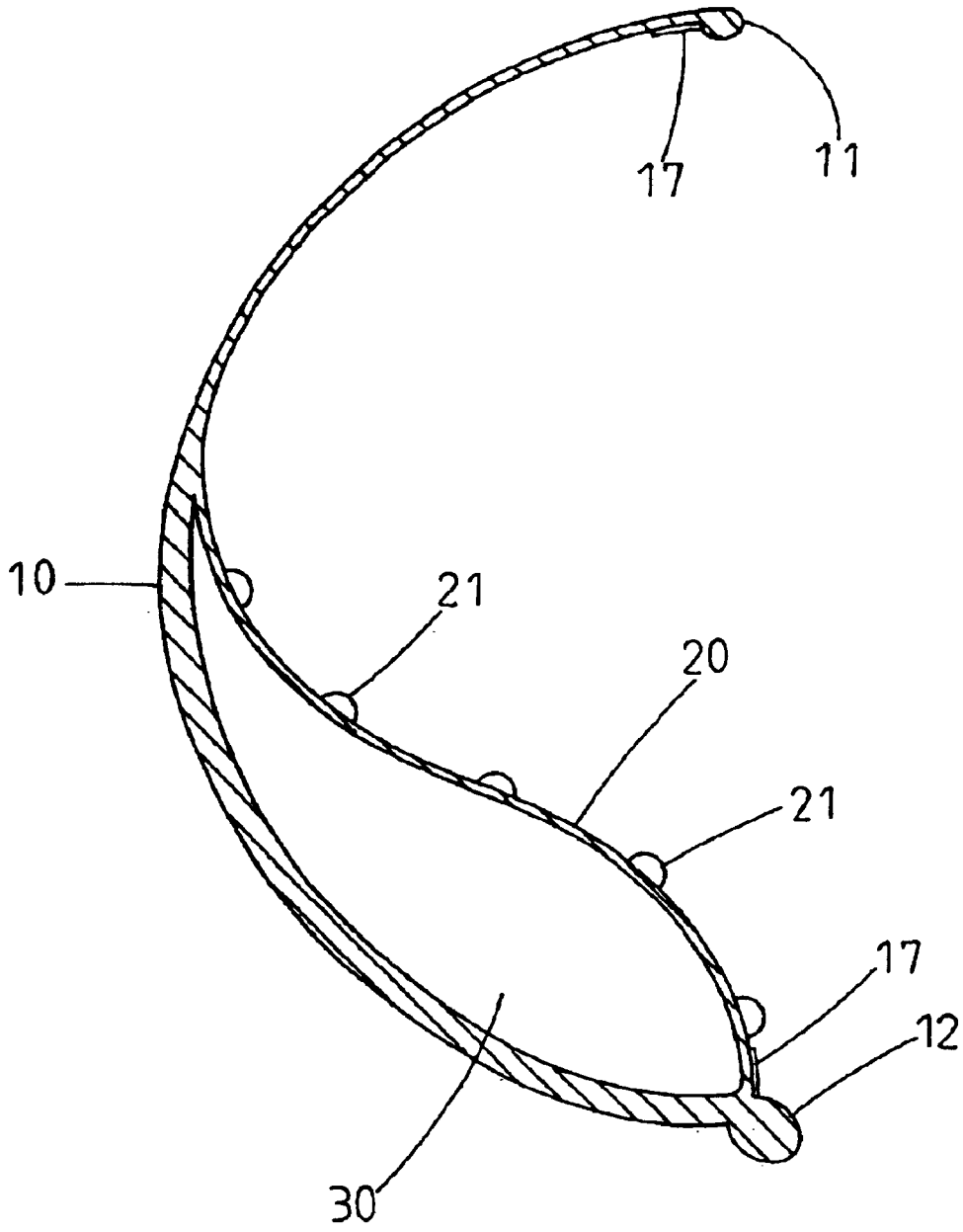
FIG. 3 is a sectional view of the bra in FIG. 1.

Referring to FIGS. 1 through 3, a first embodiment of a bra in accordance with the present invention comprises a bowl-like body 10 made of silicone rubber or other high molecular polymers. Silicone rubber is one of elastomeric rubbers of highly molecular polymers with elastomericity, slow-aging property, light resistance, chemical resistance, and insulating property. Further, light powders capable of emitting far infrared rays may be added into the material for the body 10. The body 10 includes an outline for mating with that of a female bosom.

The body 10 includes a reinforcing rib 11 extending along a top edge of a perimeter thereof. The body 10 further includes a reinforcing rib 12 extending along a remaining portion of the perimeter thereof. A rear member 20 includes a perimeter integrally formed with a lower portion of an inner side of the body 10, with the remaining portion of the rear member 20 spaced from the rear side of the body 10, defining an air chamber 30 between the rear member 20 and the lower portion of the body 10. Preferably, the rear member 20 is made of a material the same as that of the body 10. In this embodiment the rear member 20 extends from a bottom to an intermediate portion of the inner side the body 10.

A plurality of protrusions 21 are formed on an outer face of the rear member 20 for elastomeric intimate contact with the bosom of the user. Thus, a massaging effect is provided while the bosom of the user moves. Further, the gaps among the protrusions 21 provide a ventilating effect, improving wearing comfort.

In manufacture, a molding core is provided for forming the air chamber 30. The molding core is removed after formation of the body 1 along a lateral direction via a side opening in the body 1. The side opening is then sealed. Magnetic ceramic particles, polystyrene particles, or light-emitting particles may be filled into the air chamber 30 before sealing.

An air-permeable double side tape 17 (FIG. 3) is mounted to the inner side of the body 10 and extends along the perimeter of the body 10 for attaching the body 10 to the bosom of the user.

Figure 4:
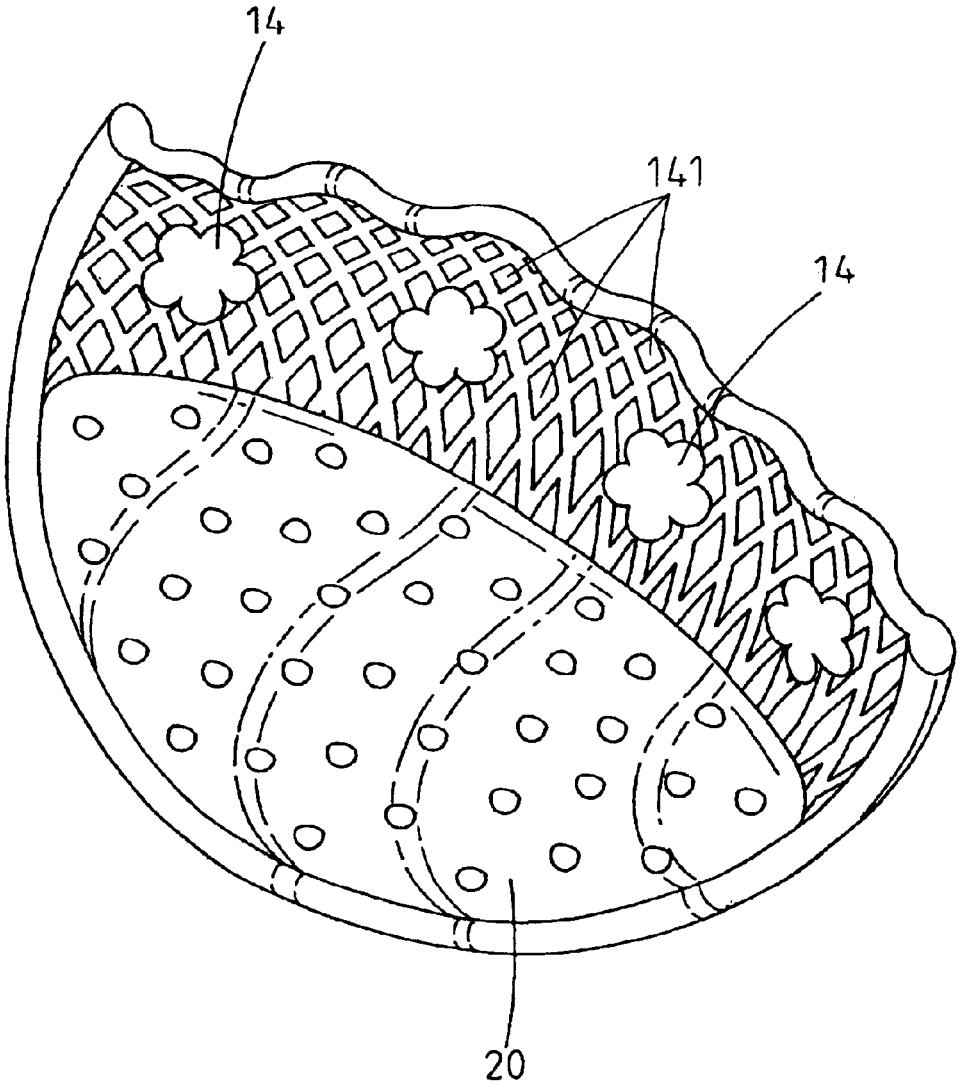
FIG. 4 is a rear perspective view of a second embodiment of the bra in accordance with the present invention.

FIG. 4 illustrates a second embodiment of the invention, wherein a plurality of vents 141 are provided in an upper portion of the rear member 20. Further, a plurality of projections 14 are formed on at least one of an inner side and an outer side of the upper portion of the body 10.

Figure 5:
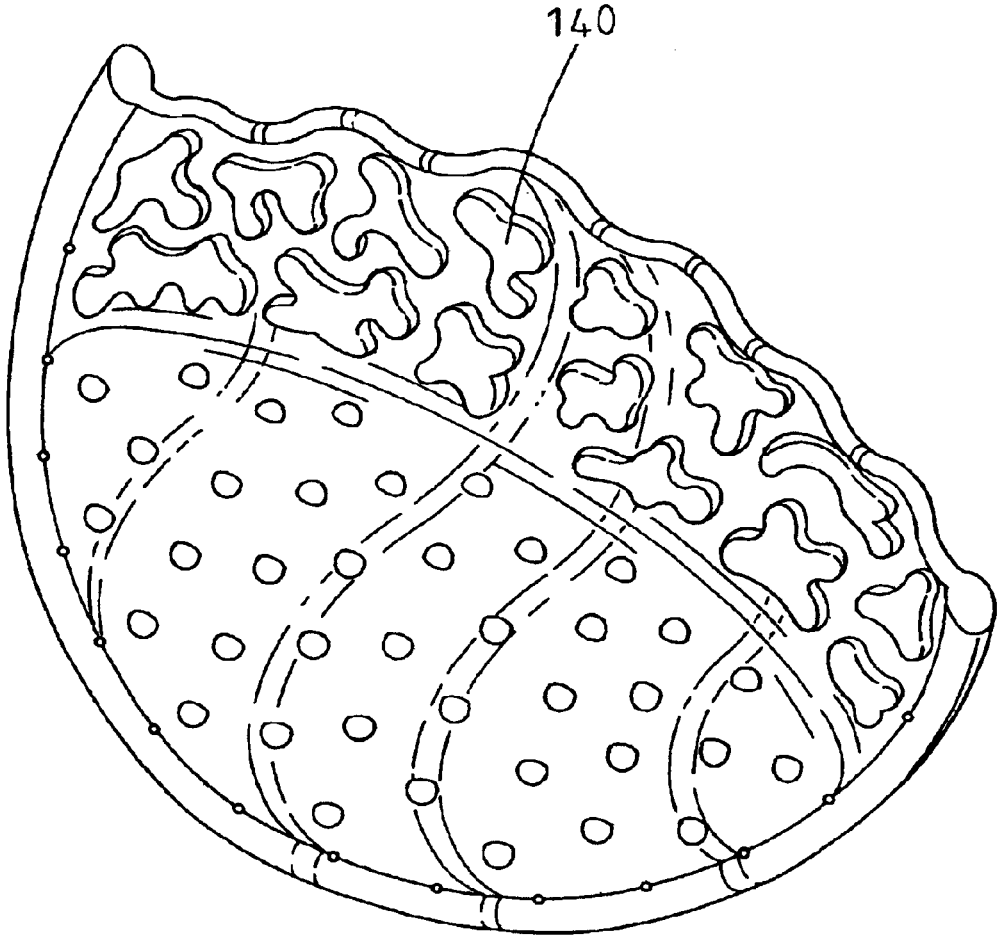
FIG. 5 is a rear perspective view of a third embodiment of the bra in accordance with the present invention.

FIG. 5 illustrates a third embodiment of the invention, wherein a plurality of projections 140 are formed on at least one of an inner side and an outer side of the upper portion of the body 10. The projections 140 on the inner side of the upper portion of the body 10 provide a ventilating function by the gaps therebetween. Nevertheless, no vent hole is provided in the upper portion of the body 10. The protrusions 140 and 141 may be of decorative patterns to provide an aesthetically pleasing effect.

Figure 6:
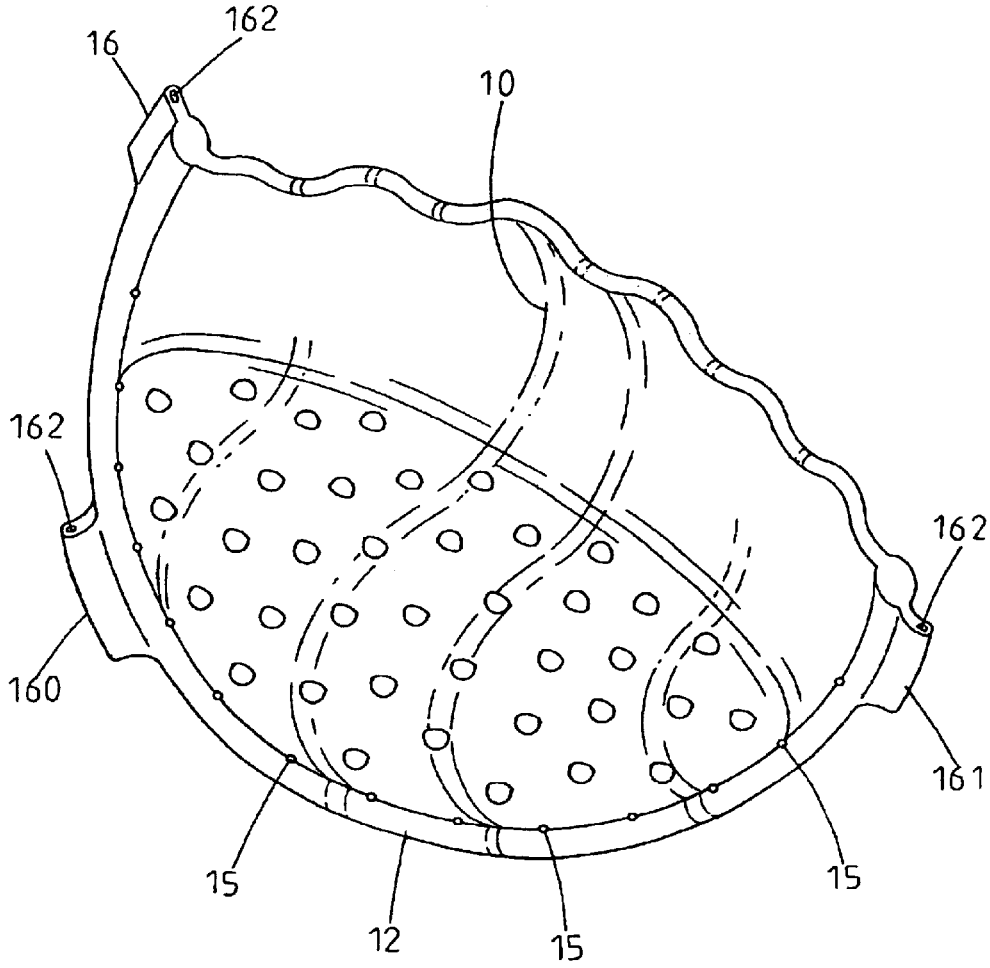
FIG. 6 is a rear perspective view of a fourth embodiment of the bra in accordance with the present invention.
Figure 7:
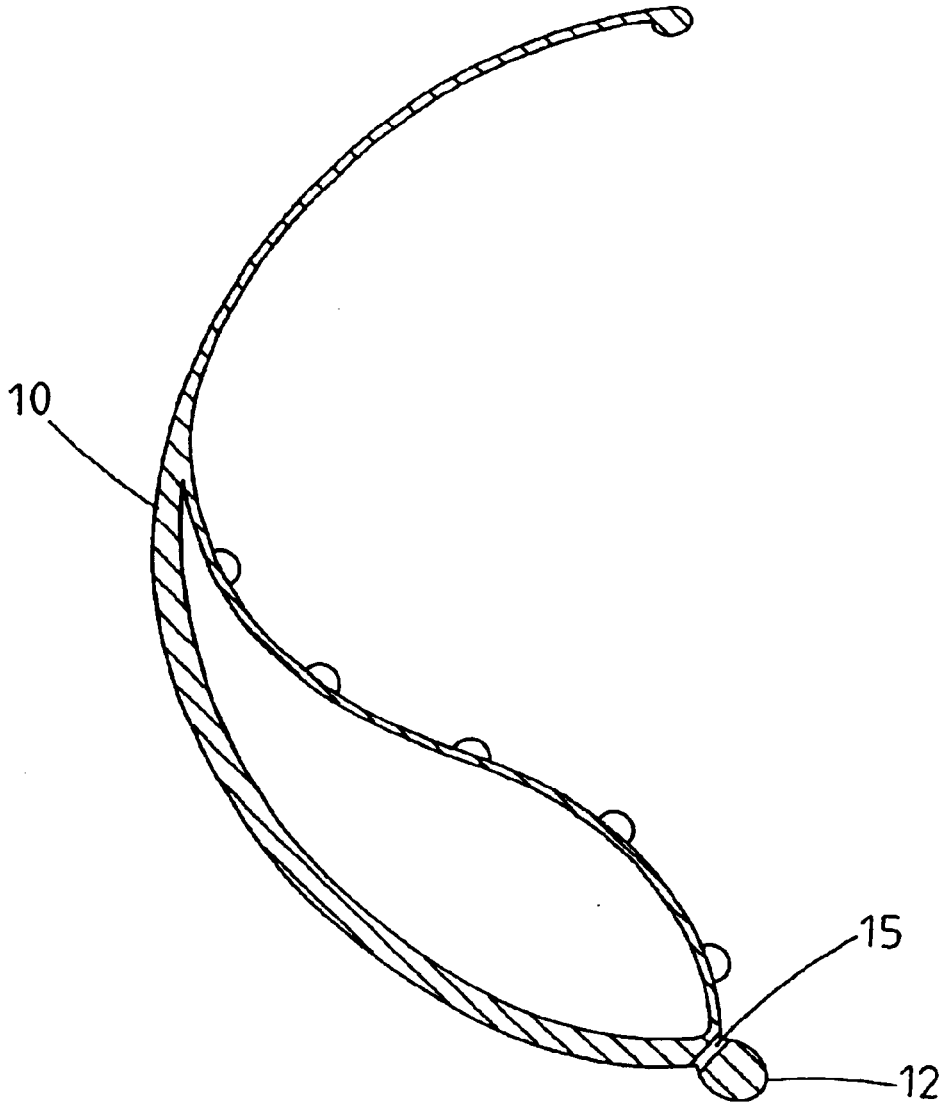
FIG. 7 is a sectional view of the bra in FIG. 6.
Figure 8:
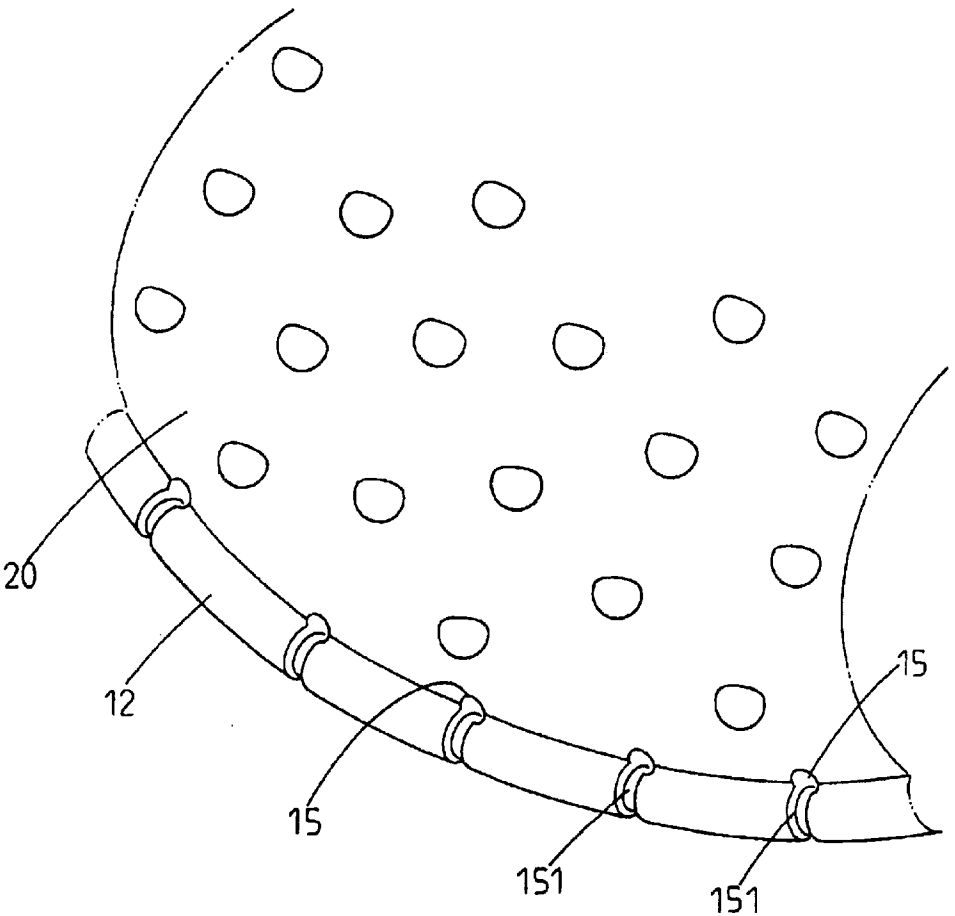
FIG. 8 is an exploded perspective view illustrating another ventilating structure for the bra in FIG. 7.

FIGS. 6 and 7 illustrate a fourth embodiment of the invention, wherein the reinforcing rib 12 includes a plurality of lugs 16, 160, and 161 on an outer edge thereof, with each lug 16, 160, 161 having a longitudinal hole 162. The lugs 16 and 160 are provided for engaging with a shoulder strap or back strap, and the lug 161 is provided for connecting with a body of a similarly constructed bra. Alternatively, the lugs 161 of two bodies 10 are integrally formed to thereby form a complete bar. In this case, the double side tape can be omitted. Further, a plurality of vents 15 are defined in a jointing are between the reinforcing rib 12 and the body 10. FIG. 8 illustrates another ventilating structure, wherein a plurality of grooves 151 are provided in the reinforcing rib 12, with each groove 151 being communicated with two ends of an associated vent 15.

Figure 9:
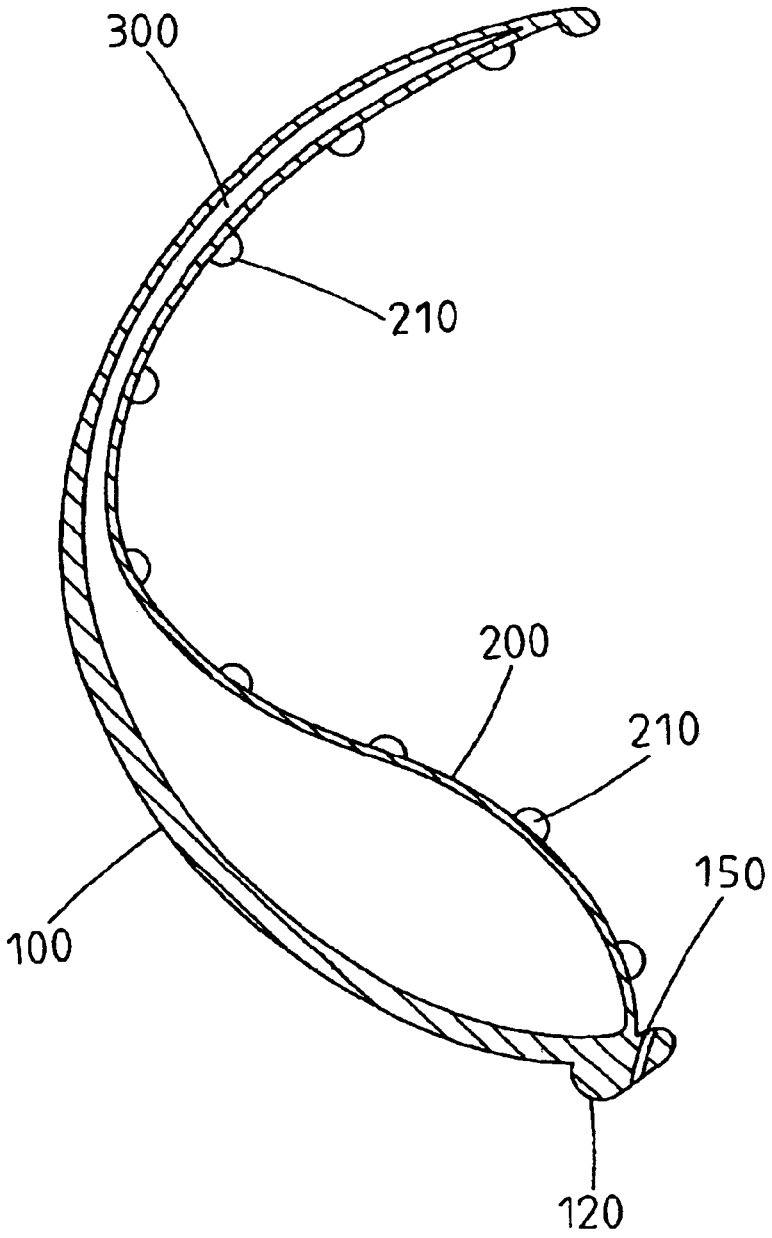
FIG. 9 is a sectional view of a fifth embodiment of the bra in accordance with the present invention.

FIG. 9 illustrates a fifth embodiment of the invention, wherein the body 100 includes an air chamber 300 extending throughout a length of the body 100, with a lower portion of the air chamber 300 being larger than an upper portion of the air chamber 300. In other words, the perimeter of the rear member 200 are integrally formed with the perimeter of the body 10. A plurality of protrusions 210 are formed on an outer face of the rear member 200 of the body 100. Further, the reinforcing rib 120 extending along the remaining portion of the body 10 includes a plurality of vents 150 in a rear portion thereof.

Figure 10:
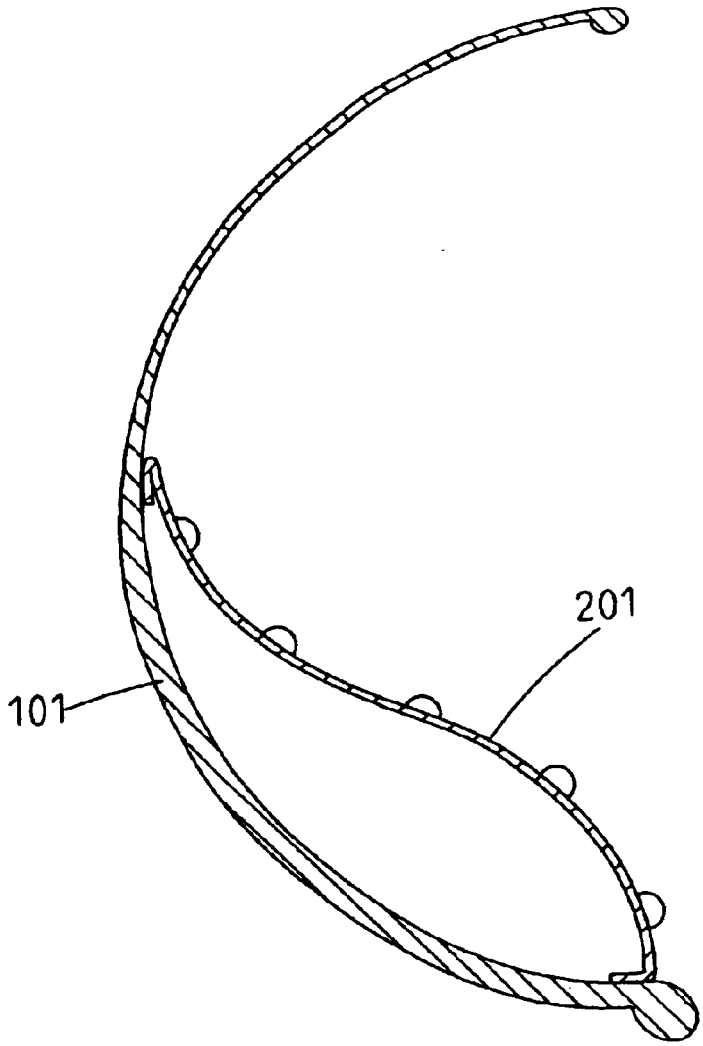
FIG. 10 is a sectional view of a sixth embodiment of the bra in accordance with the present invention.

FIG. 10 illustrates a sixth embodiment of the invention, wherein the rear member 201 is originally separate from the body 101. In other words, the rear member 201 and the body 101 are formed separately, and the rear member 201 is then bonded to the inner side of the body 101.

Figure 11:
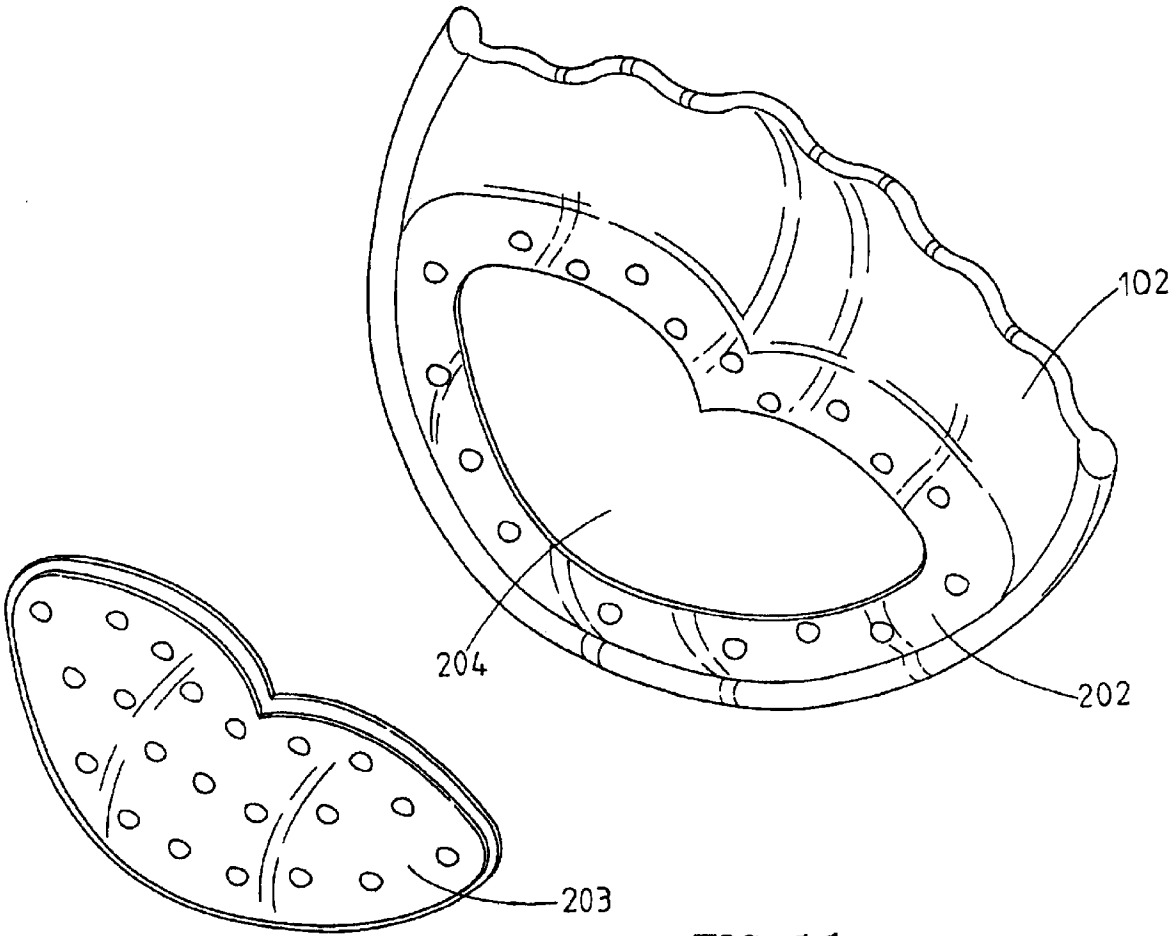
FIG. 11 is an exploded perspective view of a seventh embodiment of the bra in accordance with the present invention.
Figure 12:
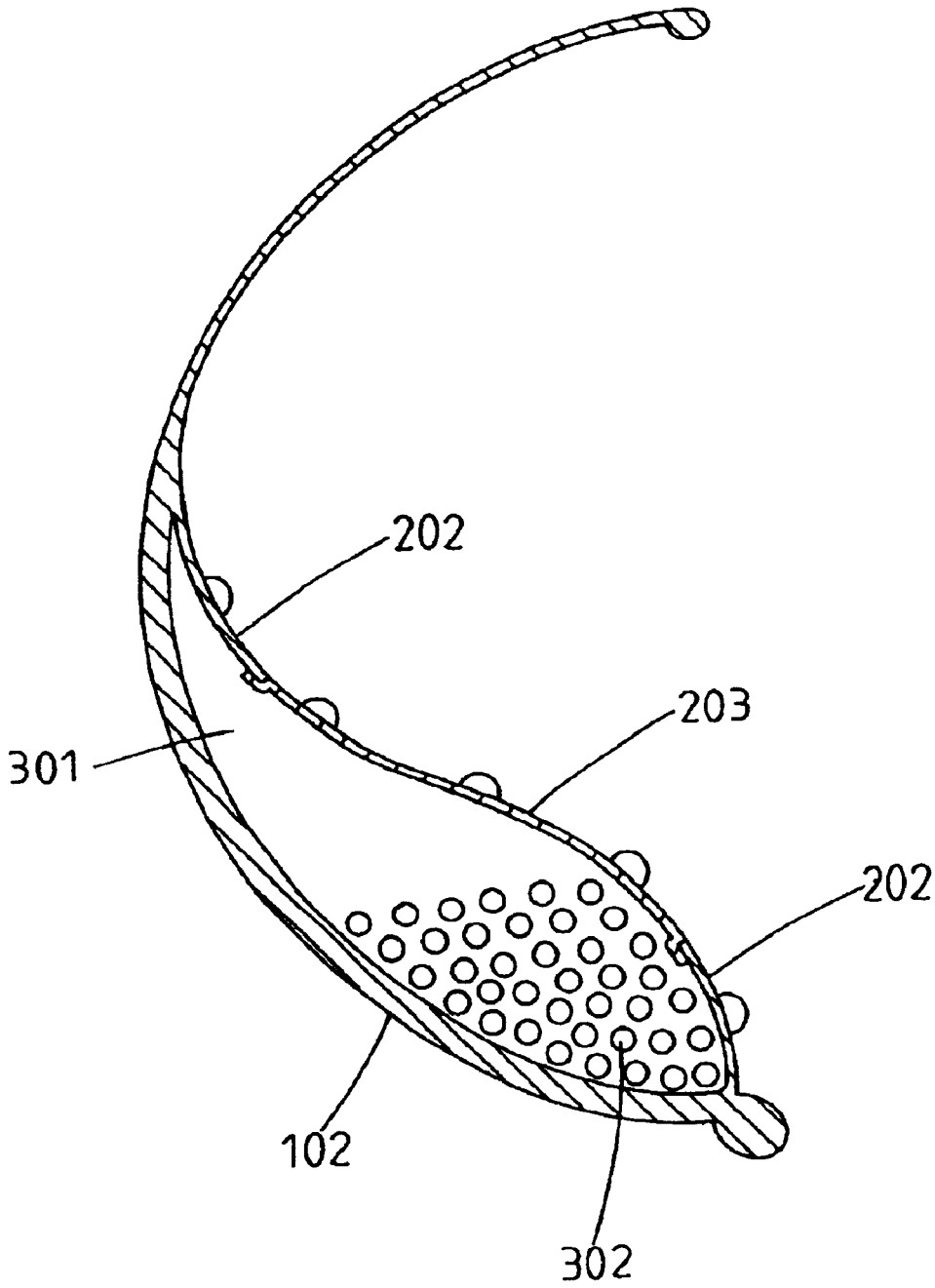
FIG. 12 is a sectional view of the bra in FIG. 11.

FIGS. 11 and 12 illustrate a seventh embodiment of the invention, wherein the rear member includes a loop portion 202 integrally formed with the inner side of the body 102 and defines a compartment with an opening 204. A bladder 203 is inserted into the compartment and seals the opening 204. Fillings 302 such as magnetic particles, polystyrene particles, and light-emitting particles may be filled into an air chamber 301 of the bladder 203.

Figure 13:
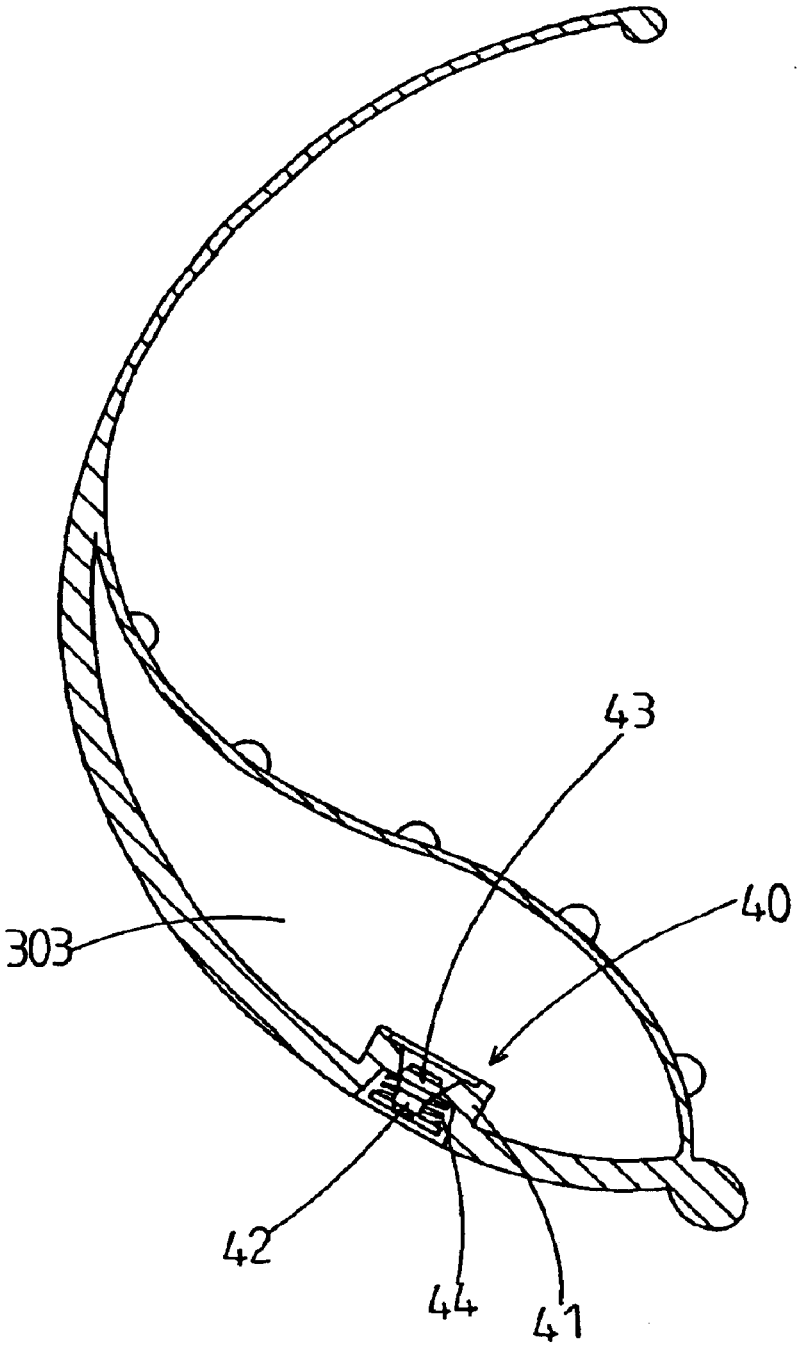
FIG. 13 is a sectional view of an eighth embodiment of the bra in accordance with the present invention.
Figure 14:
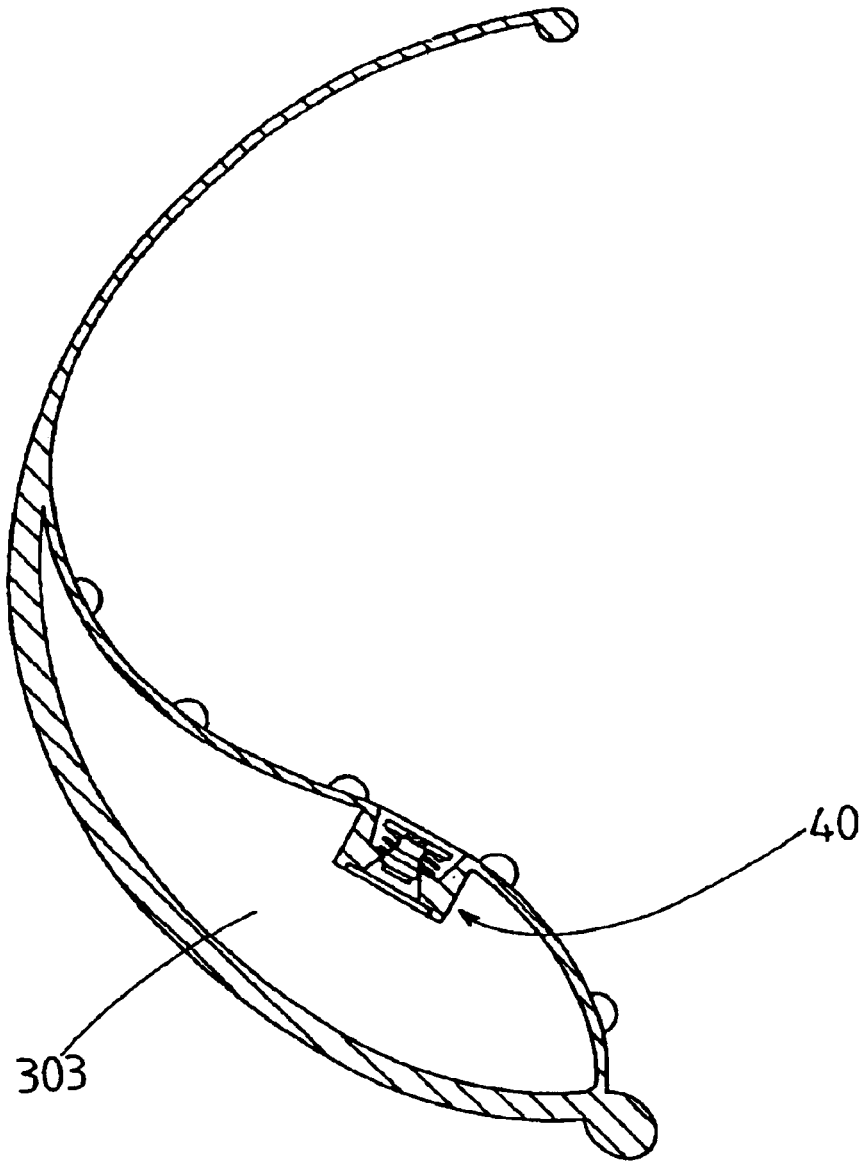
FIG. 14 is a sectional view of a ninth embodiment of the bra in accordance with the present invention.

FIG. 13 illustrates an eight embodiment of the invention, wherein a normally closed valve 40 is mounted in the body 10, allowing inflation of air into the air chamber 303 or release of air out of the air chamber 303. The valve 40 includes a valve seat 41, a valve stem 42, a valve plug 43, and a spring 44. The valve 40 may be mounted in the rear member, as shown in FIG. 14.

Figure 15:
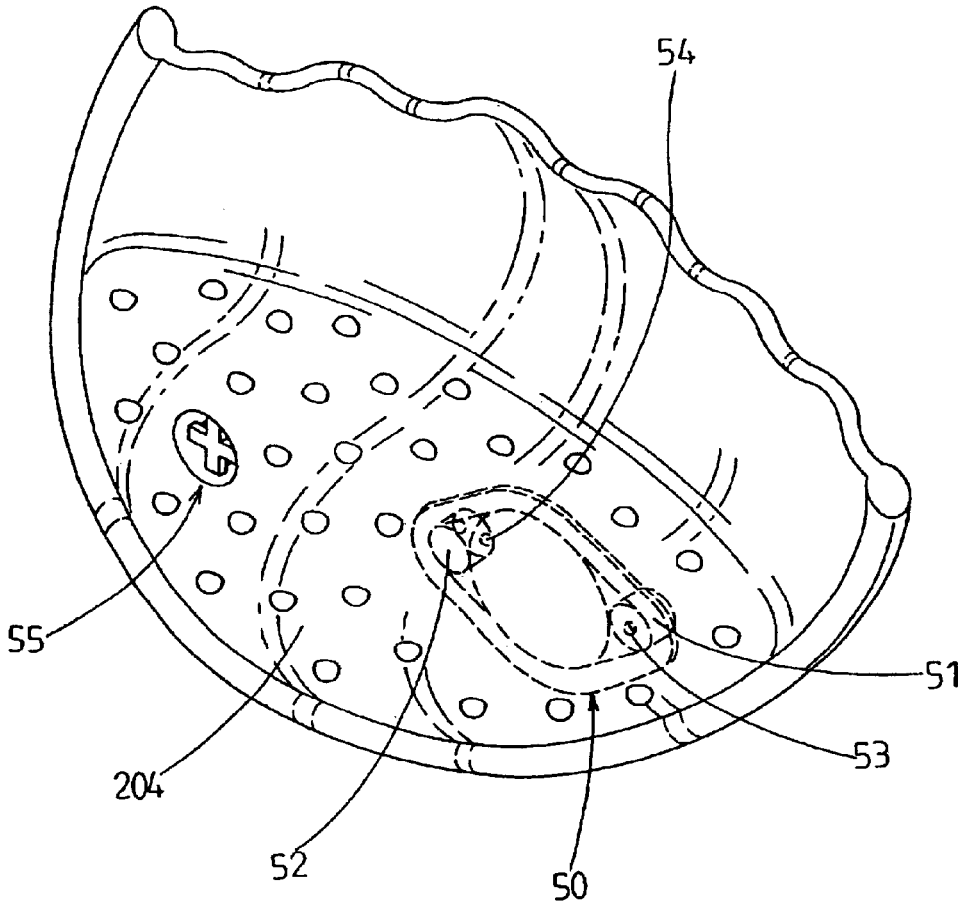
FIG. 15 is a rear perspective view of a tenth embodiment of the bra in accordance with the present invention.

FIG. 15 illustrates another embodiment of the invention, wherein a hand-operating pump 50 is pre-mounted (by, e.g., welding) to an inner face of the rear member 204. The pump 50 includes a first one-way inlet valve 51, a second one-way outlet valve 52, an air inlet 53 communicated with the air chamber, an air outlet 54 communicated wit the air chamber, and a normally closed air outlet valve 55. The pump 50 allows inflation of air into and deflation of air out of the air chamber through manual operation.

The bras in accordance with the present invention provide a massaging effect while providing the required supporting effect. In addition, the wearing comfort is improved.

Although specific embodiments have been illustrated and described, numerous modifications and variations are still possible without departing from the essence of the invention. The scope of the invention is limited by the accompanying claims.

What is claimed is:

1. A bra comprising:

a body made of silicone rubber and including an outline adapted to mate with that of a female bosom, the body including a reinforcing rib formed along a perimeter of the body; and a rear member mounted to an inner side of the body, an air chamber being defined between the rear member and the body, the rear member including a plurality of protrusions formed on an outer face thereof, the protrusions being adapted to be in contact with the female bosom for massaging the female bosom, and gaps being formed among the protrusions for ventilation.

2. The bra as claimed in claim 1 wherein the rear member extends from a bottom of the inner side of the body to an intermediate portion of the inner side the body.

3. The bra as claimed in claim 1 wherein the rear member extends from a bottom of the inner side of the body to an upper portion of the inner side the body.

4. The bra as claimed in claim 1 wherein the body further includes a double side tape mounted to the inner side of the body and extending along the perimeter of the body.

5. The bra as claimed in claim 1 wherein the body further includes at least one projection formed on at least one of an inner side and an outer side of an upper portion of the body and located above the air chamber.

6. The bra as claimed in claim 5 wherein the body further includes at least one vent located above the air chamber.

7. The bra as claimed in claim 1 wherein the reinforcing rib further includes at least one lug formed thereon, said at least one lug including a longitudinal hole.

8. The bra as claimed in claim 1 wherein the bra further includes a plurality of vents in a jointing area between the reinforcing rib and the perimeter of the body.

9. The bra as claimed in claim 8 wherein the reinforcing rib further includes a plurality of grooves, each said groove being communicated with two ends of an associated one of the vents.

10. The bra as claimed in claim 1 wherein the body and the rear member are integrally formed.

11. The bra as claimed in claim 1 wherein the bra is adapted to be integrally formed with a similarly constructed bra.

12. The bra as claimed in claim 1 wherein the body and the rear member are separately formed.

13. The bra as claimed in claim 1 wherein the rear member includes a loop portion fixed to the inner side of the member, defining a compartment with an opening, a bladder being mounted into the compartment and defining the air chamber.

14. The bra as claimed in claim 1 wherein the bra further includes a valve for controlling an amount of air in the air chamber.

15. The bra as claimed in claim 1 wherein the bra further includes a hand-operating pump mounted to an inner face of the rear member for controlling an amount of air in the air chamber.

16. The bra as claimed in claim 1 wherein the bra further includes a filling mounted in the air chamber.

17. The bra as claimed in claim 16 wherein the filling includes at least one of magnetic particles, polystyrene particles, and light-emitting particles.

* * * * *